United States Patent [19]

Kuo

[11] Patent Number: 4,785,307

[45] Date of Patent: Nov. 15, 1988

[54] CROSSED LOG-PERIODIC DIPOLE ANTENNA AND METHOD OF MAKING SAME

[75] Inventor: Samuel C. Kuo, Saratoga, Calif.

[73] Assignee: GTE Government Systems Corporation, Stamford, Conn.

[21] Appl. No.: 61,624

[22] Filed: Jun. 15, 1987

[51] Int. Cl.[4] ..... H01Q 11/10

[52] U.S. Cl. ..... 343/792.5; 343/878; 343/879

[58] Field of Search ..... 343/792.5, 878, 879, 343/888, 890, 891, 892, 797, 798, 799, 800, 905

[56] References Cited

U.S. PATENT DOCUMENTS

| | | | |
|---|---|---|---|
| 2,888,677 | 5/1959 | Masters | 343/879 |
| 3,500,423 | 3/1970 | Church | 343/792.5 |
| 3,683,392 | 8/1972 | White | 343/888 |

FOREIGN PATENT DOCUMENTS

| | | | |
|---|---|---|---|
| 1903219 | 7/1970 | Fed. Rep. of Germany | 343/792.5 |
| 1362741 | 8/1974 | United Kingdom | 343/792.5 |

*Primary Examiner*—William L. Sikes
*Assistant Examiner*—Hoanganh Le
*Attorney, Agent, or Firm*—Douglas M. Gilbert; John F. Lawler

[57] ABSTRACT

A crossed log-periodic dipole antenna having a unique feedline/boom structure providing improved antenna performance. The antenna is assembled from a pair of orthogonally displaced log-periodic antennas each having a pair of half-dipole structures, each structure having a half-dipole assembly and a central feed boom. The half-dipole assembly comprises a single sheet of conducting material formed to provide a central boom portion and a plurality of half-dipole elements projecting radially from opposite sides of the boom. The boom portion has a reduced thickness, a shape which complements that of the outer surface of the boom, and is press-fitted against and bonded to the boom exterior to form an integrated rigid unit. This configuration minimizes the force required to connect each half-dipole assembly with the adjacent boom, decreases the offset distance between the two dipole halves of each antenna, and reduces the electrical shadowing effect of the booms on the antennas.

The invention also comprehends a method of making such an antenna.

14 Claims, 6 Drawing Sheets

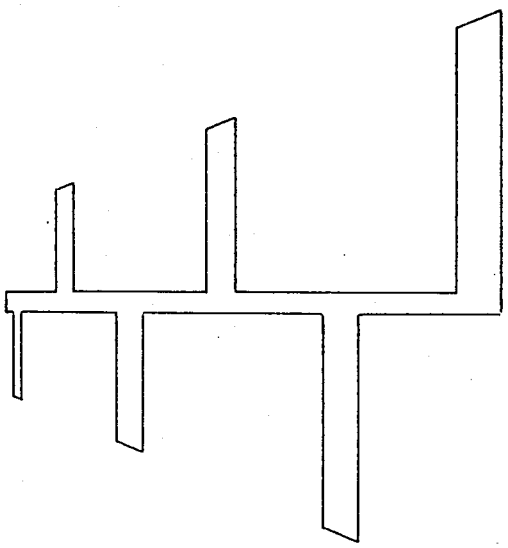
FIG. 1 (a) STRAIGHT BOOM
PRIOR ART
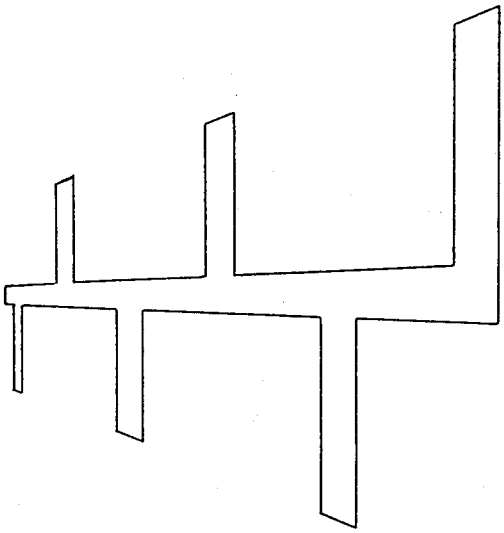
FIG. 1 (b) TAPERED BOOM
PRIOR ART

CROSSED LOG-PERIODIC DIPOLE ANTENNA AND METHOD OF MAKING SAME

BACKGROUND OF THE INVENTION

1. Field of the Invention

The present invention relates to log-periodic antennas and more particularly to an improved crossed log-periodic dipole antenna and a method of constructing same.

2. Description of the Prior Art

The crossed log-periodic dipole antenna (LPDA) consists of two orthogonally displaced indentical log-periodic dipole antennas. The crossed LPDA provides two independent, orthogonal linear polarizations. When used in a polarimeter system the purity of the two orthogonal linear polarations, which are defined by the cross-polarization level, is very important to the performance of the system. The cross-polarization level of crossed LPDAs used in these systems should be at least 20 dB below the beam peak of the matched polarization. Circular polarization can also be obtained with the crossed LPDA with the use of a 90° hybrid. Circular polarization performance also depends on the cross-polarization level which should be 15 dB or more below the matched polarization. For a well constructed crossed LPDA operating in the VHF or UHF frequency range, 15 or 20 dB cross-polarization level is relatively easy to obtain. At such wavelengths the length of the smallest dipole is much greater than the diameter of the feed booms.

A crossed LPDA designed to operate at frequencies of 12 GHz or higher cannot be assembled with this conventional construction technique. At such wavelengths the diameter of the feed boom is too large compared to the length of the dipole. For high VHF and microwave frequency LPDA operation, semi-rigid coaxial cables are often used as support booms as well as the feedlines for the antenna. The dipole halves are soldered directly to the semi-rigid coaxial cables. The 0.141" and 0.085" diameter coaxial cables are often used as the feedline/boom for LPDAs in the high VHF and microwave frequencies because of their relatively small size and rigidity. For crossed LPDAs which are required to operate at 12 GHz or higher frequencies, even the small 0.085" semi-rigid coaxial cable has too large a cross section for proper performance. At such frequencies, using conventional construction techniques, the diameter of the feed booms is so large compared to the length of the smallest dipole halves that the displacement between the two smallest dipole halves is almost the same as the length of the smallest dipole half. Performance analysis of this type of antenna is based on the assumption that each dipole has two colinear dipole halves with a feed source in the center of the dipole. In other words, the displacement between the two dipole halves is assumed to be zero, and the dipole halves are free of interference from the excitation apparatus (feedline/boom). A significant displacement between dipole halves introduces undesireable cross polarization. Moreover, close proximity of the feedline/boom structure to a significant length of the dipole halves perturbs the radiation performance of the dipoles, that is, the dipole is electrically shadowed by the feedline/boom itself.

One technique for improving the performance of this antenna is to reduce the size (diameter) of the semi-rigid coaxial cable which is also used as the antenna boom. Such an approach not only reduces the displacement between dipole halves but also reduces the shadowing effect as well. A typical diameter of such cable is 0.047". However, there are two major problems in the fabrication of crossed LPDAs using 0.047" semi-rigid coaxial cables. They are:

(1) If the crossed LPDA has a high frequency requirement of 12 GHz or higher and has an operating band of 6:1, the 0.047" coaxial cable has insufficient structural rigidity to support the larger dipole elements.

(2) Since the dipole halves are soldered directly to the antenna boom, the close proximities of adjacent dipole halves make soldering nearly impossible. This is because heat transfer adversely affects the already soldered nearest dipole element. While exotic processes such as laser welding, electron beam welding or electro-plating are available to attach dipole halves to the boom simultaneously, the required assembly fixtures are elaborate, quite expensive and a new fixture is required for each new design.

A technique was developed approximately 10 years ago to solve these problems.

(1) The radiating element, which consists of dipole halves and their supporting boom, is constructed using a chemical etching process from 0.16" thick brass sheets. FIG. 1 illustrates two types of these radiating elements, one with a straight boom 1(*a*) and the other with a tapered boom 1(*b*).

(2) Two 0.047" coaxial cables are soldered to two dipole halves booms for feedline. Two copper or brass rods having a diameter similar to the diameter of the feed coaxial cable are soldered to the other two dipole half booms for symmetry.

(3) The four dipole halves, two with coaxial cables feedlines and two with brass or copper rods, are then arranged to form a crossed LPDA. The four dipole halves can be formed into two different configurations of crossed LPDAs which are shown in FIG. 2(*a*) and 2(*b*). The configuration shown in FIG. 2(*a*) have the coaxial cable feedlines on the inside of the dipole halves. In this configuration, the two dipole halves (which form each planar LPDA) are considerably spatially displaced. If this antenna is designed to operate up to 18 GHz, the smallest dipole half is approximately 0.16" and the displacement between the two smallest dipole halves is in the neighborhood of 0.14" which is almost the same as the smallest dipole half. The crossed LPDA structure shown in FIG. 2(*b*) is characterized by a straight or tapered dielectric square rod which is used to support the four dipole halves, one on each side. The size of the square rod is determined by the outline of the dipole supporting boom. The four dipole halves and supporting booms form two orthogonal pairs of balanced microstrip transmission lines. The size of the square rod and the dielectrical constant of the material used to make the rod determine the characteristic impedance of the microstrip transmission lines. In this configuration, the spacing between the smallest dipole halves is acceptable, but the proximity effect or electrical shadowing effect of the feed cable is quite large. It can be seen from FIG. 2(*b*) that the 0.047" coaxial cable is shadowing almost of 50% of the dipole halves. The shadowing effect pertubates the performance of this antenna. Thus, this configuration is also undesirable.

This invention is directed to an improved LPDA construction and method of making it which overcome the above mentioned disadvantages.

OBJECTS AND SUMMARY OF THE INVENTION

A general object of the invention is the provision of a microwave or higher frequency crossed LPDA construction in which displacement between two dipole halves is substantially minimized.

A further object is the provision of such an antenna construction in which the electrical shadowing effect of the feedline/boom on the dipole halves is substantially reduced.

Still another object is the provision of such an antenna construction that has sufficient rigidity to support larger dipole elements present in a broad frequency band crossed LPDA.

A further object is the provision of a method of making such an antenna which achieves the foregoing objects efficiently using conventional low cost soldering techniques.

These and other objects of the invention are achieved with an LPDA construction in which each half-dipole structure comprises a boom, and half-dipole assembly formed from a single conducting sheet with a central boom portion of reduced thickness and press fitted against and permanently bonded to the boom. The curved boom portion of the one-piece conducting sheet reinforces the boom throughout its length to provide the desired rigidity. The invention also includes a method of making such an antenna by forming half-dipole assemblies from a single conductive sheet with a central boom portion from which the half-dipoles project, press fitting the boom portion of each assembly tightly against the adjacent boom, and permanently bonding the boom portion to the boom.

BRIEF DESCRIPTION OF THE DRAWINGS

FIG. 1 is a plan view of a portion of two different types of radiators of a log-periodic prior art antenna.

DESCRIPTION OF PREFERRED EMBODIMENTS

Figure 2:
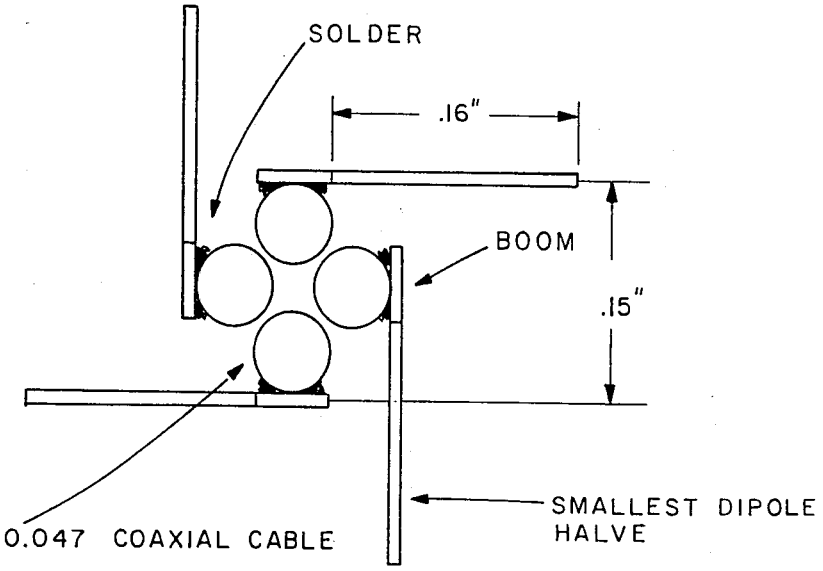
FIG. 2 (a) PRIOR ART
FIG. 2 is an enlarged transverse section of a crossed LPDA's showing two prior art feedline/boom constructions.
Figure 2B:
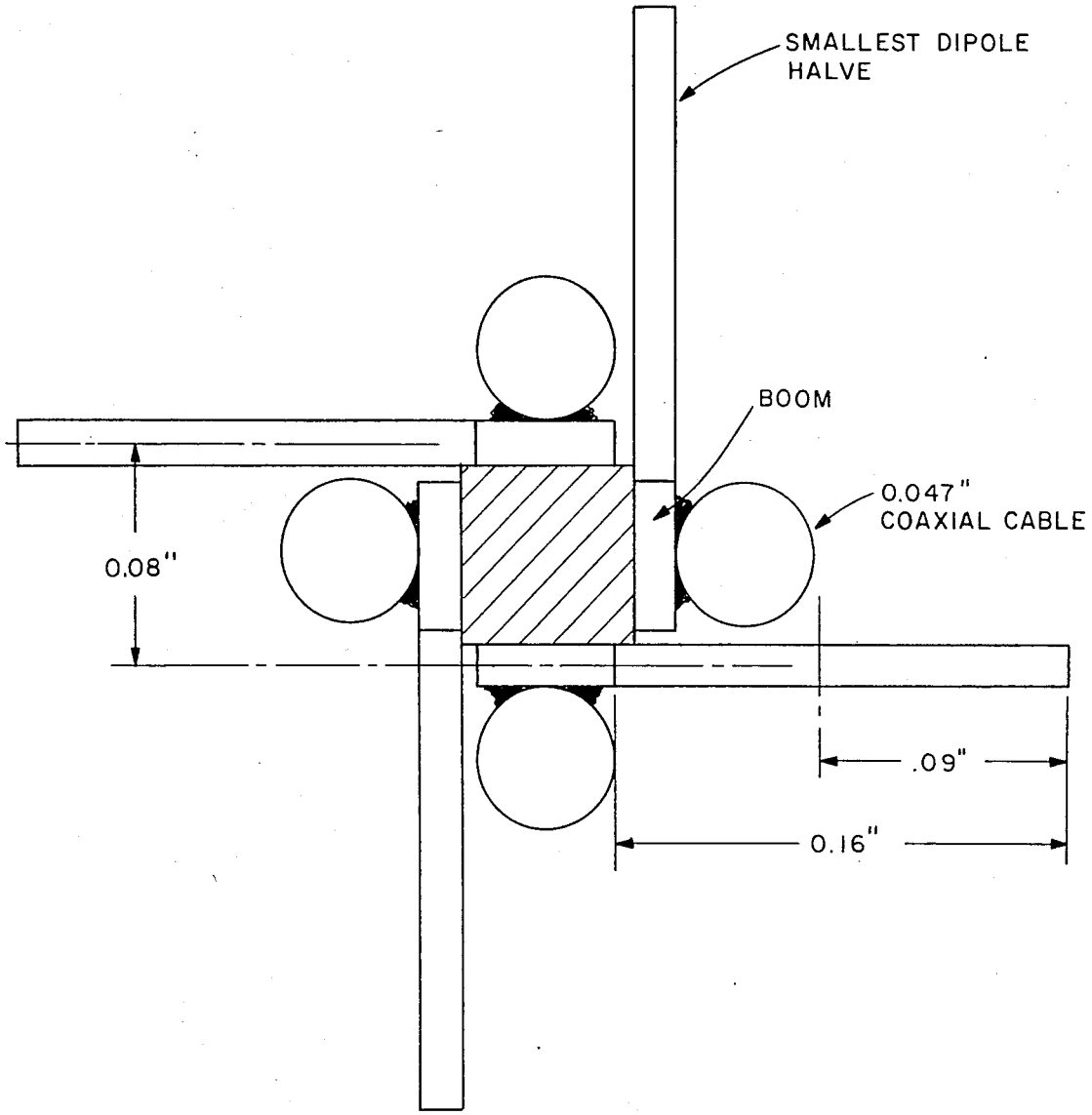
FIG. 2(b) PRIOR ART
Figure 3:
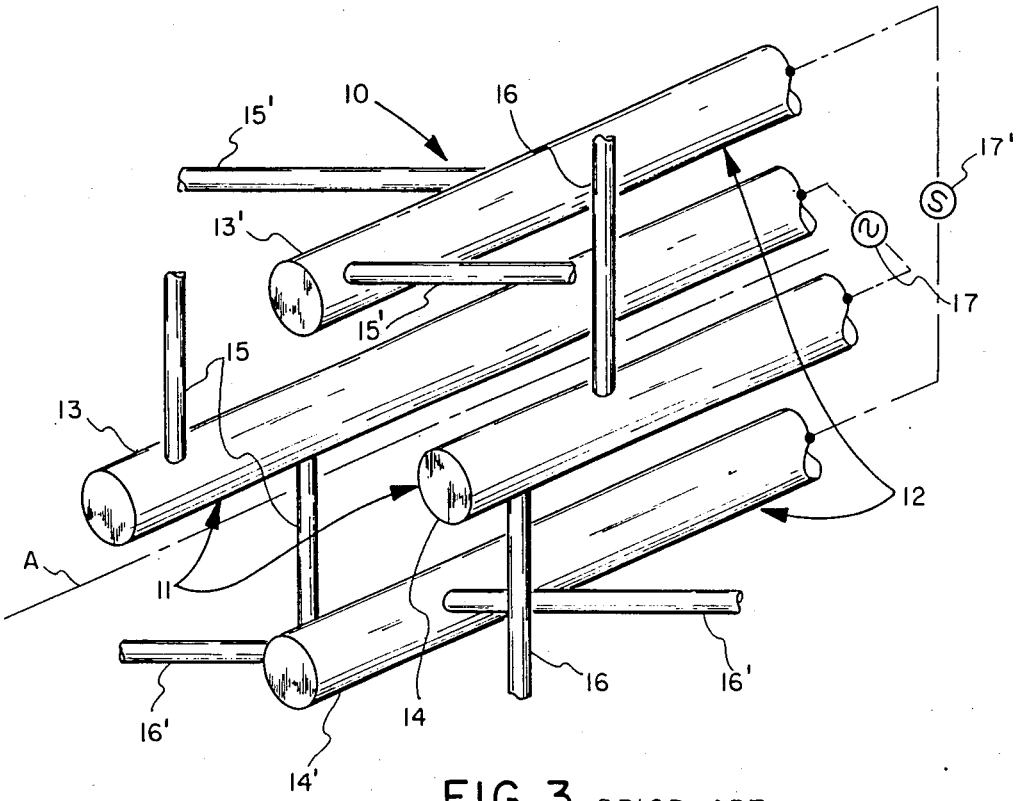
FIG. 3 PRIOR ART
FIG. 3 is a perspective schematic view of a portion of a crossed LPDA of the prior art.
Figure 4:
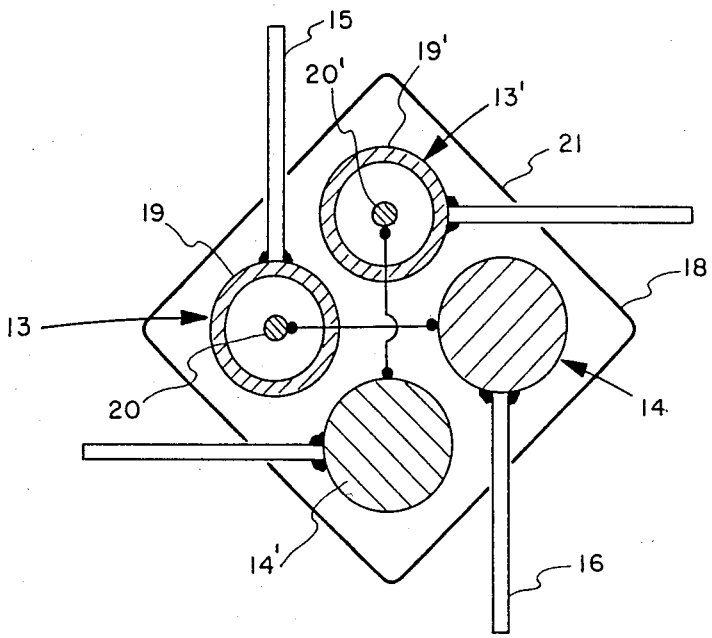
FIG. 4 PRIOR ART
FIG. 4 is a slightly enlarged transverse section of the prior art antenna of FIG. 3 showing the feed point detail of a typical feedline/boom construction.

Referring now to the drawings, FIGS. 3 and 4 show a prior art crossed LPDA construction 10 having a longitudinal axis A and consisting of two orthogonally displaced identical axially extending LPDAs 11 and 12, antenna 11 being vertically polarized, as viewed, and antenna 12 being horizontally polarized. Since the LPDAs are identical, except for their polarizations, only one, antenna 11, will be described, like reference characters and their primes indicating like parts on the drawings. Antenna 11 has two laterally offset booms 13 and 14 to which half-dipoles 15 and 16, respectively, are connected; the half-dipoles are arranged in pairs, the half-dipoles of each pair being identical in length, transversely aligned and laterally offset for functioning as a single dipole element. The lengths and axial spacings of the dipole elements increase from the high frequency end to the low frequency end of construction 10 in increments of a predetermined ratio as is well-known in the art of log-periodic antennas.

Figure 6:
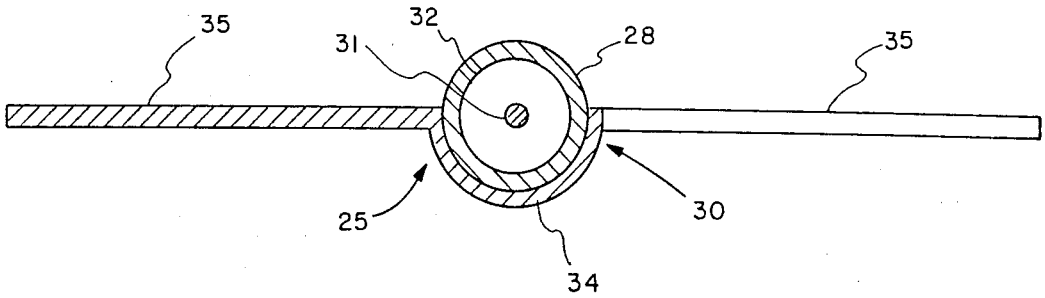
FIG. 6 is an enlarged end view of a boom/feedline and half-dipole assembly connected thereto.

Booms 13 and 14 are electrically connected to a feed source 17, such as a transmitter or receiver, and function as feedlines for the associated dipole halves. As shown in FIG. 6, booms 13 and 13' of antennas 11 and 12 may consist of coaxial cables having outer conductors 19 and 19' connected to the associated dipole halves by soldering or the like and inner conductors 20 and 20' electrically connected to opposed booms 14 and 14', respectively, shown as solid bars. Antennas 11 and 12 are supported in appropriate laterally spaced relation by one or more dielectric spacers 21. The disadvantage of such conventional construction techniques at frequencies above 8 GHz is electrical shadowing of the dipoles by the booms as is readily apparent in FIG. 6; such shadowing adversely affects performance of the antennas.

Figure 5:
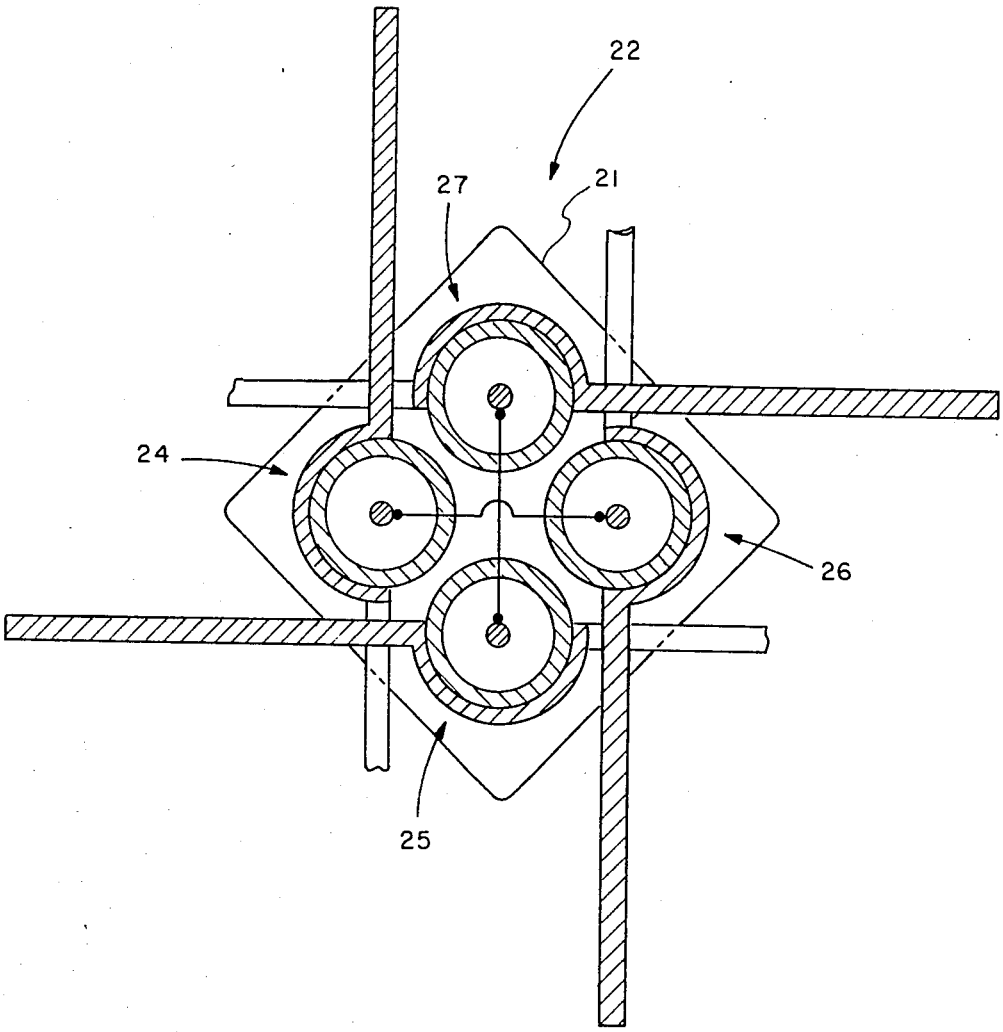
FIG. 5 is a transverse section of an LPDA embodying this invention showing the boom/feedlines as coaxial cables.

Referring now to FIGS. 5 and 6, a crossed LPDA construction 22 embodying this invention comprises four half-dipole structures 24, 25, 26 and 27 arranged in opposed pairs to constitute two orthogonally displaced LPDAs. Structures 24 and 26 are mirror images of each other as are structures 25 and 27. Each of structures 24, 25, 26 and 27 comprises a boom/feedline 28 and a half-dipole assembly 30. As its name implies, boom/feedline 28 functions both as a supporting boom and as a feedline for the antenna, and for sake of convenience will be referred to herein by the abbreviated name "boom." Booms 28 preferably are identical and each comprises a semi-rigid coaxial cable as shown having an inner conductor 31 and an outer conductor 32. Inner conductor 31 of one boom is electrically connected to the outer conductor 32 of the opposite boom.

Figure 7:
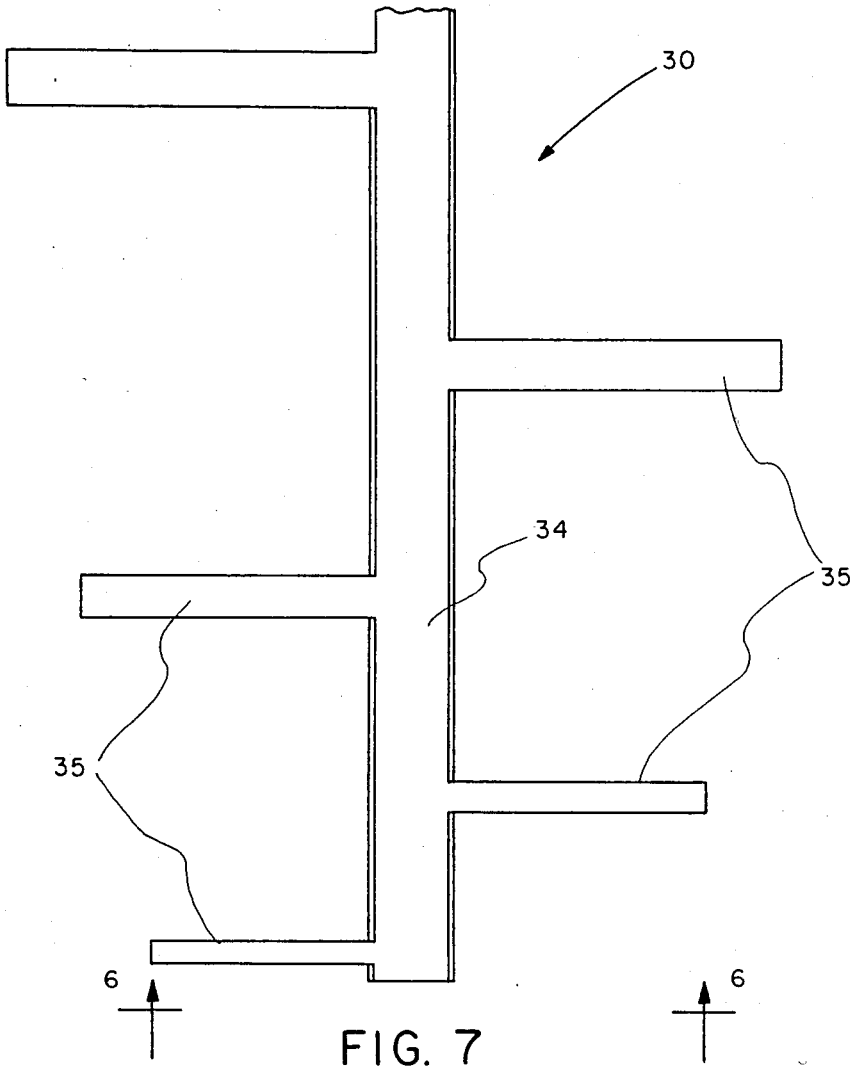
FIG. 7 is a plan view of a portion of the half-dipole assembly forming part of this invention.
Figure 8:
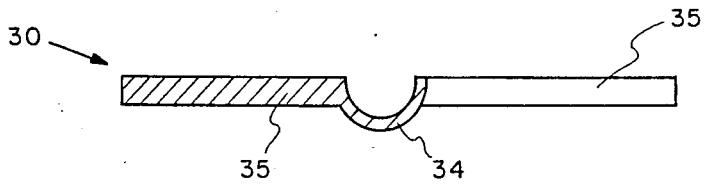
FIG. 8 is an end view taken on line 6—6 of FIG. 7.

Assembly 30 of each structure is formed by chemical milling or the like from a single sheet of electrically conductive material such as half-hard brass or beryllium copper and comprises a central longitudinally extending boom portion 34, see FIGS. 7 and 8, and log-periodic half-dipole elements 35. In order to connect assembly 30 to boom 28, boom portion 34 is press-formed into a semi-cylindrical cross-sectional shape with a diameter equal to the outside diameter of boom 28 and is permanently bonded to boom 28 throughout its length by soldering or the like. Such connection additionally contributes to the rigidity of the boom. Since a brass sheet of the desired length having a thickness sufficient to make elements self-supporting is difficult to press-form into such a shape, the wall thickness of the brass sheet along boom portion 34 is reduced by chem-etching or by conventional machining techniques by about one-half prior to the press-forming operation. Such reduction of wall thickness of boom portion 34 not only makes the shaping operation thereof easier to perform but also aids in minimizing the lateral offset spacing between the halves of the dipoles.

By way of example, semi-rigid coaxial cables having outside diameters of 0.047" have been used successfully as booms 28. A brass sheet having a thickness of 0.016" is used for the half-dipole assembly 30, the boom portion 34 thereof having a thickness of 0.008" or less. For a crossed LPDA construction embodying this invention and designed to operate up to 12 Ghz, the chemical-milling technique is satisfactory to form elements 35. For applications requiring operation at frequencies above 12 GHz, electronic discharge machining (EDM) is preferred for forming elements 35. In the latter process, the thinning of boom portion 34 is performed first using conventional machining techniques and elements 35 are thereafter formed by EDM.

It will be noted that practice of this invention enables use of relatively small diameter coaxial cables as the booms to minimize electrical shadowing. Also any compromise of rigidity in boom 28 because of its desirably small diameter is more than compensated by bonding of the semicylindrical boom portion 34 thereto throughout its length.

The invention also includes the method of making the crossed LPDA construction consisting of forming each of the half-dipole assemblies from a single piece of electrically conductive material and thereby providing a central longitudinally extending boom portion and associated half-dipole elements projecting therefrom, reducing the thickness of the boom portion, forming the boom portion to conform to the shape of the exterior of the boom, pressing the boom portion tightly against the outer surface of the adjacent boom, and permanently bonding the boom portion to said adjacent boom.

What is claimed is:

1. In a crossed log-periodic dipole antenna construction having an axis, said construction having:

first and second orthogonally displaced log-periodic antennas;

each of said antennas having first and second half-dipole structures;

each of said structures comprising an electrically conductive elongated boom having an outer surface and extending parallel to said axis, said structure also having a half-dipole assembly comprising half-dipole elements connected to and extending axially alternately from and perpendicular to opposite sides of said boom, the lengths of said elements of each assembly and the inter-element axial spacing thereof increasing from one end of the boom to the other in increments of a predetermined ratio, each half-dipole element of each of said assemblies being transversely aligned with a corresponding half-dipole element of the same size of the assembly of the other structures of the same antenna; and means for electrically feeding each of said booms, said booms being the feed lines for said half-dipole elements, the improvement comprising:

each of said half-dipole assemblies constituting a unitary piece having a boom portion with said elements projecting therefrom, said boom portion having a thickness substantially less than that of the remainder of the assembly, said boom portion being electrically connected to and tightly engaging at least a portion of said outer surface of the adjacent boom.

2. The antenna construction according to claim 1 in which each of said assemblies is composed of electrically conducting sheet material.

3. The antenna construction according to claim 1 in which the shape of the boom portion of each assembly conforms to the contour of said outer surface of the corresponding boom.

4. The antenna construction according to claim 3 in which said boom portion of each of said assemblies is press-fitted against and bonded to said outer surface of the boom.

5. The antenna construction according to claim 1 in which the shape of the boom portion of each assembly is semi-cylindrical.

6. In a cross log-periodic dipole antenna construction having an axis, said antenna construction having:

first and second orthogonally displaced log-periodic antennas;

each of said antennas having first and second half-dipole structures;

each of said structures comprising an elongated boom having an outer surface and extending parallel to said axis, said structure also having a half-dipole assembly comprising half-dipole elements connected to and extending axially alternately from and perpendicular to opposite sides of said boom, the lengths of said elements of each assembly and the inter-element axial spacings thereof increasing from one end of the boom to the other in increments of a predetermined ratio, each half-dipole element of each of said assemblies being transversely aligned with a corresponding half-dipole element of the same size of the assembly of the other structure of the same antenna; and means for electrically feeding each of said booms, said booms being the feed lines for said half-dipole elements, the improvement in which:

each of said half-dipole assemblies constituting a unitary piece having a boom portion with said elements projecting therefrom, said boom portion being press fitted against and tightly engaging at least a portion of said outer surface of the adjacent boom.

7. The antenna assembly according to claim 6 in which said boom portion of each assembly is bonded to the adjacent boom.

8. The antenna assembly according to claim 7 with said boom portion of each assembly soldered to said adjacent boom.

9. The antenna assembly according to claim 8 in which the boom portion of each assembly is substantially thinner than the remainder of the assembly.

10. The method of making a crossed log-periodic dipole antenna construction having an axis and having first and second orthogonally displaced log-periodic antennas, each of said antennas having first and second half-dipole structures, each of said structures having an elongated boom with an outer surface and extending parallel to said axis, said structure also having a half-dipole assembly comprising half-dipole elements connected to and extending axially alternatively from and perpendicular to opposite sides of said boom, the lengths of said elements of each assembly and the inter-element axial spacings thereof increasing from one end of the boom to the other in increments of a predetermined ratio, each half-dipole element of each of said assemblies being transversely aligned with a corresponding half-dipole element of the same size of the assembly of the other structure of the same antenna, and means for electrically feeding each of said booms for electrically energising said half-dipole elements, the method consisting of the steps of:

forming each of said assemblies from a unitary planar piece of electrically conductive material and thereby making a central boom portion from which the associated half-dipoles project;

pressing said boom portion of each assembly into a shape corresponding to that of the outer surface of the boom; and permanently bonding said boom portion of each structure to the adjacent boom.

11. The method according to claim 10 with the additional step of reducing the thickness of said boom portion of the assembly prior to the bonding step.

12. The method according to claim 10 in which the boom portion of each assembly is soldered to the adjacent boom.

13. A crossed log-periodic dipole antenna for use above 8 GHz, said antenna comprising:

a pair of orthogonally displaced log-periodic antennas aligned to have common axis, each antenna having first and second half-dipole structures, each of said half-dipole structures comprising:

an elongated boom extending parallel to said axis and having a semicylindrical shape;

a half-dipole assembly formed as a unitary piece with said elongated boom and having a plurality of planar half-dipole elements projecting therefrom, said elements having a thickness less than that of said boom, said elements being connected to and extending alternately from and perpendicular to opposite sides of said elongated boom, the lengths of said elements of each assembly and the inter-element axial spacings thereof increasing from one end of the boom to the other in increments of a predetermined ratio, each half-dipole element being transversely aligned with a corresponding half-dipole element of the same size of the other half-dipole structure of the same antenna; and coaxial cable means coextensive with and electrically bonded to said boom of each half-dipole structure and forming the feed line for each of said half-dipole elements.

14. The antenna according to claim 13 in which said cable means is press-fitted against the inner surface of said semi-cylindrically shaped boom.

* * * * *